US005599400A

United States Patent [19]

Mao et al.

[11] Patent Number: 5,599,400

[45] Date of Patent: Feb. 4, 1997

[54] LIGHT DUTY LIQUID OR GEL DISHWASHING DETERGENT COMPOSITIONS CONTAINING PROTEASE

[75] Inventors: Mark H. Mao; Janet L. Marshall; Martha O. Visscher, all of Cincinnati, Ohio

[73] Assignee: The Procter & Gamble Company, Cincinnati, Ohio

[21] Appl. No.: 466,946

[22] Filed: Jun. 6, 1995

Related U.S. Application Data

[63] Continuation of Ser. No. 121,331, Sep. 14, 1993, abandoned.

[51] Int. Cl.[6] ..... B08B 3/00; C11D 3/382

[52] U.S. Cl. ..... 134/25.2; 510/235; 510/236; 510/237; 510/392; 510/520

[58] Field of Search ..... 252/174.12, DIG. 12, 252/174.17, 174.21, 549, 550, DIG. 5; 135/25.2; 510/235, 236, 237, 392, 520; 134/25.2

[56] References Cited

U.S. PATENT DOCUMENTS

| | | | |
|---|---|---|---|
| 3,553,139 | 1/1971 | McCarty et al. | 252/95 |
| 3,627,688 | 12/1971 | McCarty | 252/153 |
| 3,634,266 | 1/1972 | Theile | 252/132 |
| 3,635,828 | 1/1972 | Benjamin et al. | 252/99 |
| 3,676,374 | 7/1972 | Zaki et al. | 252/551 |
| 3,682,842 | 8/1972 | Innerfield | 252/539 |
| 3,707,504 | 12/1972 | Johnson et al. | 252/135 |
| 3,707,505 | 12/1972 | Maeda et al. | 252/136 |
| 3,755,085 | 8/1973 | Tivin et al. | 195/68 |
| 3,840,480 | 10/1974 | Barrat et al. | 252/545 |
| 3,983,079 | 9/1976 | Spadini et al. | 252/545 |
| 4,072,632 | 2/1978 | Reed | 252/541 |
| 4,101,457 | 7/1978 | Place et al. | 252/559 |
| 4,133,779 | 1/1979 | Hellyer et al. | 252/547 |
| 4,162,987 | 7/1979 | Maguire, Jr. et al. | 252/135 |
| 4,166,048 | 8/1979 | Nishimura et al. | 252/546 |
| 4,169,817 | 10/1979 | Weber | 252/545 |
| 4,238,345 | 12/1980 | Guilbert | 252/174.12 |
| 4,287,082 | 9/1981 | Tolfo et al. | 252/174.12 |
| 4,305,837 | 12/1981 | Kaminsky et al. | 252/174.12 |
| 4,316,842 | 2/1982 | Chauvette | 260/245.2 R |
| 4,318,818 | 3/1982 | Letton et al. | 252/174.12 |
| 4,490,285 | 12/1984 | Kebanli | 252/551 |
| 4,568,476 | 2/1986 | Kielman et al. | 252/95 |
| 4,597,886 | 7/1986 | Goedhart et al. | 252/95 |
| 4,681,704 | 7/1987 | Bernardino et al. | 252/546 |
| 4,904,359 | 2/1990 | Pancheri et al. | 252/548 |
| 4,906,396 | 3/1990 | Falholt et al. | 252/174.12 |
| 4,950,417 | 8/1990 | Bycroft et al. | 252/174.12 |
| 5,154,850 | 10/1992 | Deguchi et al. | 252/174.17 |
| 5,156,761 | 10/1992 | Aaslyng et al. | 252/174.12 |
| 5,156,773 | 10/1992 | Kochavi et al. | 252/174.12 |
| 5,221,495 | 6/1993 | Cao et al. | 252/135 |
| 5,223,179 | 6/1993 | Connor et al. | 252/548 |
| 5,376,310 | 12/1994 | Cripe et al. | 252/548 |
| 5,415,814 | 5/1995 | Ofosu-Asante et al. | 252/558 |

FOREIGN PATENT DOCUMENTS

| | | | |
|---|---|---|---|
| 626011 | 12/1961 | Belgium . | |
| 03364774 | 4/1990 | European Pat. Off. . | |
| 0375102 | 6/1990 | European Pat. Off. | C11D 3/086 |
| 7105204A | 4/1971 | Netherlands | C11D 7/42 |
| 1518807 | 7/1978 | United Kingdom | C11D 10/02 |
| 9504806 | 2/1995 | WIPO . | |

*Primary Examiner*—Paul Lieberman
*Assistant Examiner*—Kery A. Fries
*Attorney, Agent, or Firm*—Mary Pat McMahon; George W. Allen

[57] ABSTRACT

Mild detergent compositions which exhibit good cleaning performance comprise detergent surfactants and small amounts of protease. A preferred embodiment additionally contains suds boosters and divalent ions.

9 Claims, No Drawings

LIGHT DUTY LIQUID OR GEL DISHWASHING DETERGENT COMPOSITIONS CONTAINING PROTEASE

This is a continuation of application Ser. No. 08/121,331, filed Sep. 14, 1993, now abandoned.

TECHNICAL FIELD

The present invention relates to liquid or gel dishwashing detergent compositions containing detergent surfactants and low levels of protease for consumer preferred skin condition.

BACKGROUND OF THE INVENTION

Light-duty liquid or gel dishwashing detergent compositions are well known in the art. Mildness is often achieved by the usage of certain surfactants such as sulfates of highly ethoxylated alcohols, (see e.g., U.S. Pat. No. 3,743,233, Rose & Thiele), and/or alkyl ethoxy carboxylates (See Japanese Patent Applications 48-60706 and 48-64102). Betaines have also been suggested for use in improving mildness as well as the sudsing of a liquid dishwashing composition.

Likewise, the art is replete with detergent compositions containing enzymes for cleaning (see e.g., U.S. Pat. No. 3,799,879, Francke et al; U.S. Pat. No. 3,634,266, Thiele et al; U.S. Pat. No. 3,707,505, Maeda et al; and 4,162,987, Maguire, Jr. et al and 4,101,457, Place).

It has been found that proteases added to a light-duty liquid or gel dishwashing detergent composition improves the mildness of the composition, even those compositions containing harsh surfactants, and surprisingly improves the dryness of skin.

SUMMARY OF THE INVENTION

The present invention relates to a light-duty liquid or gel dishwashing detergent composition comprising by weight:

(a) from about 5% to about 99% of detergent surfactant selected from the group consisting of polyhydroxy fatty acid amides; nonionic fatty alkypolyglucosides; $C_{8-22}$ alkyl sulfates; $C_{9-15}$ alkyl benzene sulfonates, $C_{8-22}$ alkyl ether sulfates; $C_{8-22}$ olefin sulfonates; $C_{8-22}$ paraffin sulfates; $C_{8-22}$ alkyl glyceryl ether sulfonates; fatty acid ester sulfonates; secondary alcohol sulfates; $C_{12-16}$ alkyl ethoxy carboxylates; $C_{11-16}$ special soaps; ampholytic detergent surfactants; zwitterionic detergent surfactants; and mixtures thereof; and (b) from about 0.001% to about 5% active protease; said composition having a pH between about 4 to about 11.

A particularly preferred embodiment also comprises from about 1.0% to about 20% of a suds booster and 0.1% to about 4% divalent ions (i.e. magnesium and/or calcium).

DETAILED DESCRIPTION OF THE INVENTION

The light-duty liquid or gel dishwashing detergent compositions of the present invention contain two essential. components:

(1) detergent surfactants; and (2) low levels of protease effective at the pH of the detergent composition.

Optional ingredients especially suds boosters can be added to provide various performance and aesthetic characteristics.

The term "light-duty dishwashing detergent composition" as used herein refers to those compositions which are employed in manual (i.e. hand) dishwashing.

Detergent Surfactant

The compositions of this invention contain from about 5% to about 99%, preferably from about 10% to about 70%, most preferably from about 20% to about 60% of detergent surfactant.

Included in this category are several anionic surfactants commonly used in liquid or gel dishwashing detergents. The cations associated with these anionic surfactants are preferably selected from the group consisting of calcium, sodium, potassium, magnesium, ammonium or alkanol-ammonium, and mixtures thereof, preferably sodium, ammonium, calcium and magnesium and/or mixtures thereof. Examples of anionic surfactants that are useful in the present invention are the following:

(1) Alkyl benzene sulfonates in which the alkyl group contains from 9 to 15 carbon atoms, preferably 11 to 14 carbon atoms in straight chain or branched chain configuration. An especially preferred linear alkyl benzene sulfonate contains about 12 carbon atoms. U.S. Pat. Nos. 2,220,099 and 2,477,383 describe these surfactants in detail.

(2) Alkyl sulfates obtained by sulfating an alcohol having 8 to 22 carbon atoms, preferably 12 to 16 carbon atoms. The alkyl sulfates have the formula $ROSO_3^-M^+$ where R is the $C_{8-22}$ alkyl group and M is a mono- and/or divalent cation.

(3) Paraffin sulfonates having 8 to 22 carbon atoms, preferably 12 to 16 carbon atoms, in the alkyl moiety. These surfactants are commercially available as Hostapur SAS from Hoechst Colanese.

(4) Olefin sulfonates having 8 to 22 carbon atoms, preferably 12 to 16 carbon atoms: U.S. Pat. No. 3,332,880 contains a description of suitable olefin sulfonates.

(5) Alkyl ether sulfates derived from ethoxylating an alcohol having 8 to 22 carbon atoms, preferably 12 to 16 carbon atoms, less than 30, preferably less than 12, moles of ethylene oxide. The alkyl ether sulfates having the formula:

$$RO(C_2H_4O)_xSO_3^-M^+$$

where R is the $C_{8-22}$ alkyl group, x is 1–30, and M is a mono- or divalent cation.

(6) Alkyl glyceryl ether sulfonates having 8 to 22 carbon atoms, preferably 12 to 16 carbon atoms, in the alkyl moiety.

(7) Fatty acid ester sulfonates of the formula:

$$R_1—CH(SO_3^-M^+)CO_2R_2$$

wherein $R_1$ is straight or branched alkyl from about $C_8$ to $C_{18}$, preferably $C_{12}$ to $C_{16}$, and $R_2$ is straight or branched alkyl from about $C_1$ to $C_6$, preferably primarily $C_1$, and $M^+$ represents a monoor divalent cation.

(8) Secondary alcohol sulfates having 6 to 18 carbon atoms, preferably 8 to 16 carbon atoms.

(9) Alkyl ethoxy carboxylates of the generic formula $RO(CH_2CH_2O)_xCH_2COO^-M^+$ wherein R is a $C_{12}$ to $C_{16}$ alkyl group, x ranges from 0 to about 10, and the ethoxylate distribution is such that, on a weight basis, the amount of material where x is 0 is less than about 20%, preferably less than about 15%, most preferably less than about 10%, and the amount of material where x is greater than 7 is less than about 25%, preferably less than about 15%, most preferably less than about 10%, the average x is from about 2 to 4 when the average R is $C_{13}$ or less, and the average x is from about 3 to 6 when the average R is greater than $C_{13}$, and M is a cation preferably chosen from alkali metal, ammonium, mono-, di-, and tri-ethanolammonium, most preferably from sodium, potassium, ammonium, and mixtures thereof. The preferred alkyl ethoxy carboxylates are those where R is a $C_{12}$ to $C_{14}$ alkyl group.

(10) The following general structures illustrate some of the "special soaps", or their precursor acids (aka $C_{11-16}$ alkyl carboxyls) employed in this invention:

A. A highly preferred class of soaps used herein comprises the $C_{10}$–$C_{16}$ secondary carboxyl materials of the formula $R^3$ $CH(R^4)COOM$, wherein $R^3$ is $CH_3(CH_2)_x$ and $R^4$ is $CH_3(CH_2)_y$, wherein y can be 0 or an integer from 1 to 6, x is an integer from 6 to 12 and the sum of (x+y) is 6–12, preferably 7–11, most preferably 8–9.

B. Another class of special soaps useful herein comprises those carboxyl compounds wherein the carboxyl substituent is on a ring hydrocarbyl unit, i.e., secondary soaps of the formula $R^5$—$R^6$—COOM, wherein $R^5$ is $C_7$–$C_{10}$, preferably $C_8$–$C_9$, alkyl or alkenyl and $R^6$ is a ring structure, such as benzene, cyclopentane, cyclohexane, and the like. (Note: $R^5$ can be in the ortho, meta or para position relative to the carboxyl on the ring.)

C. Still another class of soaps includes the $C_{10}$–$C_{18}$ primary and secondary carboxyl compounds of the formula $R^7CH(R^8)COOM$, wherein the sum of the carbons in $R^7$ and $R^8$ is 8–16, $R^7$ is of the form $CH_3$—$(CHR^9)_x$ and $R^8$ is of the form H—$(CHR^9)_y$, where x and y are integers in the range 0–15 and $R^9$ is H or a $C_{1-4}$ linear or branched alkyl group. $R^9$ can be any combination of H and $C_{1-4}$ linear or branched alkyl group members within a single —$(CHR^9)_{x,y}$ group; however, each molecule in this class must contain at least one $R^9$ that is not H. These types of molecules can be made by numerous methods, e.g. by hydroformylation and oxidation of branched olefins, hydroxycarboxylation of branched olefins, oxidation of the products of Guerbet reaction involving branched oxoalcohols. The branched olefins can be derived by oligomerization of shorter olefins, e.g. butene, isobutylene, branched hexene, propylene and pentene.

D. Yet another class of soaps includes the $C_{10}$–$C_{18}$ tertiary carboxyl compounds, e.g., neo-acids, of the formula $R^{10}CR^{11}(R^{12})COOM$, wherein the sum of the carbons in $R^{10}$, $R^{11}$ and $R^{12}$ is 8–16. $R^{10}$, $R^{11}$, and $R^{12}$ are of the form $CH_3$—$(CHR^{13})_x$, where x is an integer in the range 0–13, and $R^{13}$ is H or a $C_{1-4}$ linear or branched alkyl group. Note that $R^{13}$ can be any combination of H and $C_{1-4}$ linear or branched alkyl group members within a single —$(CHR^{13})_x$ group. These types of molecules result from addition of a carboxyl group to a branched olefin, e.g., by the Koch reaction. Commercial examples include the neodecanoic acid manufactured by Exxon, and the Versatic™ acids manufactured by Shell.

In each of the above formulas A, B, C and D, the species M can be any suitable, especially water-solubilizing, counterion, e.g., H, alkali metal, alkaline earth metal, ammonium, alkanolammonium, di- and tri- alkanolammonium, $C_1$–$C_5$ alkyl substituted ammonium and the like. Sodium is convenient, as is diethanoi ammonium.

Preferred secondary special soaps for use herein are water-soluble members selected from the group consisting of the water-soluble salts of 2-methyl-1-undecanoic acid, 2-ethyl-1-decanoic acid, 2-propyl-1-nonanoic acid, 2-butyl-1-octanoic acid; 2-pentyl-1-heptanoic acid; 2-methyl-1-dodecanoic acid; 2-ethyl-1-undecanoic acid; 2-propyl-1-decanoic acid; 2-butyl-1-nonanoic acid; 2-pentyl-1-octanoic acid and mixtures thereof

(11) Mixtures thereof.

The above described anionic surfactants are all available commercially. It should be noted that although both dialkyl sulfosuccinates and fatty acid ester sulfonates will function well at neutral to slightly alkaline pH, they will not be chemically stable in a composition with pH much greater than about 8.5.

Other useful surfactants for use in the compositions are the nonionic fatty alkylpolyglucosides. These surfactants contain straight chain or branched chain $C_8$ to $C_{15}$, preferably from about $C_{12}$ to $C_{14}$, alkyl groups and have an average of from about 1 to 5 glucose units, with an average of 1 to 2 glucose units being most preferred. U.S. Pat. Nos. 4,393,203 and 4,732,704, incorporated by reference, describe these surfactants.

The compositions hereof may also contain a polyhydroxy fatty acid amide surfactant of the structural formula:

$$R^2-\overset{\overset{\displaystyle O}{\|}}{C}-\overset{\overset{\displaystyle R^1}{|}}{N}-Z \qquad (I)$$

wherein: $R^1$ is H, $C_1$–$C_4$ hydrocarbyl, 2-hydroxy ethyl, 2-hydroxy propyl, or a mixture thereof, preferably $C_1$–$C_4$ alkyl, more preferably $C_1$ or $C_2$ alkyl, most preferably $C_1$ alkyl ( i.e., methyl); and $R^2$ is a $C_5$–$C_{31}$ hydrocarbyl, preferably straight chain $C_7$–$C_{19}$ alkyl or alkenyl, more preferably straight chain $C_9$–$C_{17}$ alkyl or alkenyl, most preferably straight chain $C_{11}$–$C_{17}$ alkyl or alkenyl, or mixtures thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl. Suitable reducing sugars include glucose, fructose, realrose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of —$CH_2$—$(CHOH)_n$—$CH_2OH$, —$CH(CH_2OH)$—$(CHOH)_{n-1}$—$CH_2OH$, —$CH_2$—$(CHOH)_2(CHOR')(CHOH)$—$CH_2OH$, where n is an integer from 3 to 5, inclusive, and R' is H or a cyclic or aliphatic monosaccharide, and alkoxylated derivatives thereof. Host preferred are glycityls wherein n is 4, particularly —$CH_2$—$(CHOH)_4$—$CH_2OH$.

In Formula (I), $R^1$ can be, for example, N-methyl, N-ethyl, N-propyl, N-isopropyl, N-butyl, N-2-hydroxy ethyl, or N-2-hydroxy propyl.

$R^2$—CO—N< can be, for example, cocamide, stearamide, oleamide, lauramide, myristamide, capricamide, palmitamide, tallowamide, etc.

Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

Methods for making polyhydroxy fatty acid amides are known in the art. In general, they can be made by reacting an alkyl amine with a reducing sugar in a reductive amination reaction to form a corresponding N-alkyl polyhydroxyamine, and then reacting the N-alkyl polyhydroxyamine with a fatty aliphatic ester or triglyceride in a condensation/amidation step to form the N-alkyl, N-polyhydroxy fatty acid amide product. Processes for making compositions containing polyhydroxy fatty acid amides are disclosed, for example, in G.B. Patent Specification 809,060, published Feb. 18, 1959, by Thomas Hedley & Co., Ltd., U.S. Pat. No. 2,965,576, issued Dec. 20, 1960 to E. R. Wilson, and U.S. Pat. No. 2,703,798, Anthony R. Schwartz, issued Mar. 8, 1955, U.S. Pat. Nos. 1,985,424, issued Dec. 25, 1934 to Piggott, 5,188,769, Connor et el, issued Feb. 23, 1993 and 5,194,639, Connor et el, issued Mar. 16, 1993, each of which is incorporated herein by reference.

Zwitterionic surfactants include derivatives of aliphatic quaternary ammonium, phosphonium, and sulphonium compounds in which the aliphatic moiety can be straight or branched chain and wherein one of the aliphatic substituents contains from about 8 to 24 carbon atoms and one contains an anionic water-solubilizing group. Particularly preferred zwitterionic materials are the ethoxylated ammonium sulfonates and sulfates disclosed in U.S. Pat. Nos. 3,925,262, Laughlin et al, issued Dec. 9, 1975 and 3,929,262, Laughlin et al, issued Dec. 30, 1975, said patents being incorporated herein by reference.

Ampholytic surfactants include derivatives of aliphatic or heterocyclic secondary and ternary amines in which the aliphatic moiety can be straight chain or branched and wherein one of the aliphatic substituents contains from about 8 to about 24 carbon atoms and at least one aliphatic substituent contains an anionic water-solubilizing group.

Protease Enzyme

The compositions of this invention contain from about 0.001% to about 5%, more preferably from about 0.003% to about 4%, most preferably from about 0.005% to about 3%, by weight, of active protease enzyme. Protease activity may be expressed in Anson units (A.U.) per kilogram of detergent. Levels of from 0.01 to about 150, preferably from about 0.05 to about 80, most perferably from about 0.1 to about 40 A.U. per kilogram have been found to be acceptable in compositions of the present invention.

The proteolytic enzyme can be of animal, vegetable or microorganism (preferred) origin. More preferred is serine proteolytic enzyme of bacterial origin. Purified or nonpurified forms of this enzyme may be used. Proteolytic enzymes produced by chemically or genetically modified mutants are included by definition, as are close structural enzyme variants. Particularly preferred is bacterial serine proteolytic enzyme obtained from *Bacillus, Bacillus subtilis* and/or *Bacillus licheniformis.*

Suitable proteolytic enzymes include Alcalase®, Esperase®, Durazym®, Savinase® (preferred); Maxatase®, Maxacal® (preferred), and Maxapem® 15 (protein engineered Maxacal); Purafect® (preferred) and subtilisin BPN and BPN'; which are commercially available. Preferred proteolytic enzymes are also modified bacterial serine proteases, such as those described in European Patent Application Serial Number 87 303761.8, filed Apr. 28, 1987 (particularly pages 17, 24 and 98), and which is called herein "Protease B", and in European Patent Application 199,404, Venegas, published Oct. 29, 1986, which refers to a modified bacterial serine proteolytic enzyme which is called "Protease A" herein. Preferred proteolytic enzymes, then, are selected from the group consisting of Savinase®, Alcalase®, Esperase®, Maxacal®, Purafect®, BPN', Protease A and Protease B, and mixtures thereof; more preferably Alcalase®, Savinase®, BPN' Protease B, and mixtures thereof; most preferred is Protease B.

It is believed that the protease functions primarily by providing a desquamatory action to the detergent composition. It is believed that the proteases remove damaged (e.g. dry) skin cells on the surface of the skin, thereby reducing the rough feel associated therewith. The protease removes the effect of prior damage to the skin, giving the skin a fresher, more youthful appearance and feel. When the protease is combined with a detergent surfactant the overall effect is to promote the health of the skin and to provide the consumer with a perceived mildness or skin feel/appearance advantage over other similar detergent compositions which do not contain both of the essential ingredients herein while still maintaining good cleaning performance.

pH of the Composition

Dishwashing compositions of the invention will be subjected to acidic stresses created by food soils when put to use, i.e., diluted and applied to soiled dishes. If a composition with a pH greater than 7 is to be more effective in improving performance, it should contain a buffering agent capable of maintaining the alkaline pH in the composition and in dilute solutions, i.e., about 0.1% to 0.4% by weight aqueous solution, of the composition. The pKa value of this buffering agent should be about 0.5 to 1.0 pH units below the desired pH value of the composition (determined as described above). Preferably, the pKa of the buffering agent should be from about 7 to about 9.5. Under these conditions the buffering agent most effectively controls the pH while using the least amount thereof.

The buffering agent may be an active detergent in its own right, or it may be a low molecular weight, organic or inorganic material that is used in this composition solely for maintaining an alkaline pH. Preferred buffering agents for compositions of this invention are nitrogen-containing materials. Some examples are amino acids or lower alcohol amines like mono-, di-, and tri-ethanolamine. Other preferred nitrogen-containing buffering agents are 2-amino-2-ethyl-1,3-propanediol, 2-amino-2-methyl-propanol, 2-amino-2-methyl-1,3-propanediol, tris-(hydroxymethyl)aminomethane (a.k.a. tris) and disodium glutamate. N-methyl diethanolamine, 1,3-diamino-2-propanol N,N'-tetramethyl-1,3-diamino-2-propanol, N,N-bis(2-hydroxyethyl)glycine (a.k.a. bicine), and N-tris (hydroxymethyl)methyl glycine (a.k.a. tricine) are also preferred. Mixtures of any of the above are acceptable.

The buffering agent is present in the compositions of the invention hereof at a level of from about 0.1% to 15%, preferably from about 1% to 10%, most preferably from about 2% to 8%, by weight of the composition.

Enzyme Stabilizing System

The preferred compositions herein may additionally comprise from about 0.001% to about 10%, preferably from about 0.005% to about 8%, most preferably from about 0.01% to about 6%, by weight of an enzyme stabilizing system. The enzyme stabilizing system can be any stabilizing system which is compatible with the enzyme of the present invention. Such stabilizing systems can comprise calcium ion, boric acid, propylene glycol, short chain carboxylic acid, boronic acid, polyhydroxyl compounds and mixtures thereof such as are described in U.S. Pat. Nos. 4,261,868, Hora et al, issued Apr. 14, 1981; 4,404,115, Tai, issued Sep. 13, 1983; 4,318,818, Letton et al; 4,243,543, Guildeft et al issued Jan. 6, 1981; 4,462,922, Boskamp, issued Jul. 31, 1984; 4,532,064, Boskamp, issued Jul. 30, 1985; and 4,537,707, Severson Jr., issued Aug. 27, 1985, all of which are incorporated herein by reference.

Additionally, from 0 to about 10%, preferably from about 0.01% to about 6% by weight, of chlorine bleach scavengers can be added to compositions of the present invention to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of water that comes in contact with the enzyme during dishwashing is usually large; accordingly, enzyme stability in-use can be problematic.

Suitable chlorine scavenger anions are salts containing ammonium cations. These can be selected from the group consisting of reducing materials like sulfite, bisulfite, thiosulfite, thiosulfate, iodide, etc., antioxidants like carbamate, ascorbate, etc., organic amines such as ethylenediaminetetracetic acid (EDTA) or alkali metal salt thereof and monoethanolamine (MEA), and mixtures thereof. Other conventional scavenging anions like sulfate, bisulfate, carbonate, bicarbonate, percarbonate, nitrate, chloride, borate, sodium perborate tetrahydrate, sodium perborate monohydrate, percarbonate, phosphate, condensed phosphate, acetate, benzoate, citrate, formate, lactate, malate, tartrate, salicylate, etc. and mixtures thereof can also be used. The preferred ammonium salts or other salts of the specific chlorine scavenger anions can either replace the suds controlling agent or be added in addition to the suds controlling agent.

Although ammonium salts can be admixed with the detergent composition, they are prone to adsorb water and/or give off ammonia gas. Accordingly, it is better if they are protected in a particle like that described in U.S. Pat. No. 4,652,392, Beginski et el, which is incorporated herein by reference.

Suds Boosters

Highly desirable components include from about 1% to about 20%, preferably from about 2% to about 15% of suds boosters such as betaines, ethylene oxide condensates, fatty acid amides, amine oxide semi-polar nonionics, sultaines, complex betaines and cationic surfactants.

The composition of this invention can contain betaine detergent surfactants having the general formula:

$$R—N(+)(R^1)_2—R^2COO(-)$$

wherein R is a hydrophobic group selected from the group consisting of alkyl groups containing from about 10 to about 22 carbon atoms, preferably from about 12 to about 18 carbon atoms, alkyl aryl and aryl alkyl groups containing a similar number of carbon atoms with a benzene ring being treated as equivalent to about 2 carbon atoms, and similar structures interrupted by amido or ether linkages; each $R^1$ is an alkyl group containing from 1 to about 3 carbon atoms; and $R^2$ is an alkylene group containing from 1 to about 6 carbon atoms.

Examples of preferred betaines are dodecyl dimethyl betaine, cetyl dimethyl betaine, dodecyl amidopropyldimethyl betaine, tetradecyldimethyl betaine, tetradecylamidopropyldimethyl betaine, and dodecyldimethylammonium hexanoate.

Other suitable amidoalkylbetaines are disclosed in U.S. Pat. Nos. 3,950,417; 4,137,191; and 4,375,421; and British Patent GB No. 2,103,236, all of which are incorporated herein by reference.

It will be recognized that the alkyl (and acyl) groups for the above betaine surfactants can be derived from either natural or synthetic sources, e.g., they can be derived from naturally occurring fatty acids; olefins such as those prepared by Ziegler, or Oxo processes; or from olefins separated from petroleum either with or without "cracking".

The ethylene oxide condensates are broadly defined as compounds produced by the condensation of ethylene oxide groups (hydrophilic in nature) with an organic hydrophobic compound, which can be aliphatic or alkyl aromatic in nature. The length of the hydrophilic or polyoxyalkylene radical which is condensed with any particular hydrophobic group can be readily adjusted to yield a water-soluble compound having the desired balance between hydrophilic and hydrophobic elements.

Examples of such ethylene oxide condensates suitable as suds stabilizers are the condensation products of aliphatic alcohols with ethylene oxide. The alkyl chain of the aliphatic alcohol can either be straight or branched and generally contains from about 8 to about 18, preferably from about 8 to about 14, carbon atoms for best performance as suds stabilizers, the ethylene oxide being present in amounts of from about 8 moles to about 30, preferably from about 8 to about 14 moles of ethylene oxide per mole of alcohol.

Examples of the amide surfactants useful herein include the ammonia, monoethanol, and diethanoi amides of fatty acids having an acyl moiety containing from about 8 to about 18 carbon atoms and represented by the general formula:

$$R_1—CO—N(H)_{m-1}(R_2OH)_{3-m}$$

wherein R is a saturated or unsaturated, aliphatic hydrocarbon radical having from about 7 to 21, preferably from about 11 to 17 carbon atoms; $R_2$ represents a methylene or ethylene group; and m is 1, 2, or 3, preferably 1. Specific examples of said amides are mono-ethanol amine coconut fatty acid amide and diethanoi amine dodecyl fatty acid amide. These acyl moleties may be derived from naturally occurring glycerides, e.g., coconut oil, palm oil, soybean oil, and tallow, but can be derived synthetically, e.g., by the oxidation of petroleum or by hydrogenation of carbon monoxide by the Fischer-Tropsch process. The monoethanol amides and diethanolamides of $C_{12-14}$ fatty acids are preferred.

Amine oxide semi-polar nonionic surfactants comprise compounds and mixtures of compounds having the formula:

$$R_1(C_2H_4O)_nN^+(R_2)(R_3)\cdots O^-$$

wherein $R_1$ is an alkyl, 2-hydroxyalkyl, 3-hydroxyalkyl, or 3-alkoxy-2-hydroxypropyl radical in which the alkyl and alkoxy, respectively, contain from about 8 to about 18 carbon atoms, $R_2$ and $R_3$ are each methyl, ethyl, propyl, isopropyl, 2-hydroxyethyl, 2-hydroxypropyl, or 3-hydroxypropyl, and n is from 0 to about 10. Particularly preferred are amine oxides of the formula:

$$R_1—N^+(R_2)(R_3)\cdots O^-$$

wherein $R_1$ is a $C_{12-16}$ alkyl and $R_2$ and $R_3$ are methyl or ethyl. The above ethylene oxide condensates, amides, and amine oxides are more fully described in U.S. Pat. No. 4,316,824 (Pancheri), incorporated herein by reference.

The sultaines useful in the present invention are those compounds having the formula $(R(R^1)_2N+R^2SO_3-$ wherein R is a $C_6$–$C_{18}$ hydrocarbyl group, preferably a $C_{10}$–$C_{16}$ alkyl group, more preferably a $C_{12}$–$C_{13}$ alkyl group, each $R^1$ is typically $C_1$–$C_3$ alkyl, preferably methyl, and $R^2$ is a $C_1$–$C_6$ hydrocarbyl group, preferably a $C_1$–$C_3$ alkylene or, preferably, hydroxyalkylene group. Examples of suitable sultaines include $C_{12}$–$C_{14}$ dimethylammonio-2-hydroxypropyl sulfonate, $C_{12-14}$ amido propyl ammonio-2-hydroxypropyl sultaine, $C_{12-14}$ dihydroxyethylammonio propane sulfonate, and $C_{16-18}$ dimethylammonio hexane sulfonate, with $C_{12-14}$ amido propyl ammonio-2-hydroxypropyl sultaine being preferred.

The complex betaines for use herein have the formula:

$$R-(A)_n-[\underset{\underset{B}{|}}{N}-(CHR_1)_x]_y-\underset{\underset{B}{|}}{N}-Q \qquad (I)$$

wherein R is a hydrocarbon group having from 7 to 22 carbon atoms, A is the group (C(O), n i s 0 or 1, $R_1$ i s hydrogen or a lower alkyl group, x is 2 or 3, y is an integer of 0 to 4, Q is the group $—R_2COOM$ wherein $R_2$ is an alkylene group having from 1 to 6 carbon atoms and M is hydrogen or an ion from the groups alkali metals, alkaline earth metals, ammonium and substituted ammonium and B is hydrogen or a group Q as defined.

An example of this category is alkylamphopolycarboxy glycinate of the formula:

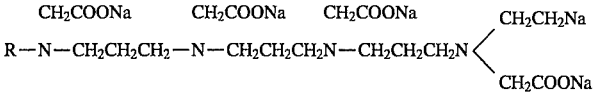

The composition of this invention can also contain certain cationic quaternary ammonium surfactants of the formula:

$$[R^1(OR^2)_y][R^3(OR^2)_y]_2R^4N^+X^-$$

or amine surfactants of the formula:

$$[R^1(OR^2)_y][R^3(OR^2)_y]R^4N$$

wherein $R^1$ is an alkyl or alkyl benzyl group having from about 6 to about 16 carbon atoms in the alkyl chain; each $R^2$ is selected from the group consisting of $—CH_2CH_2—$, $—CH_2CH(CH_3)—$, $—CH_2CH(CH_2OH)—$, $—CH_2CH_2CH_2—$, and mixtures thereof; each $R^3$ is selected from the group consisting of $C_1$–$C_4$ alkyl, $C_1$–$C_4$ hydroxyalkyl, benzyl, and hydrogen when y is not 0; $R^4$ is the same as $R^3$ or is an alkyl chain wherein the total number of carbon atoms of $R^1$ plus $R^4$ is from about 8 to about 16; each y is from 0 to about 10, and the sum of the y values is from 0 to about 15; and X is any compatible anion.

Preferred of the above are the alkyl quaternary ammonium surfactants, especially the mono-long chain alkyl surfactants described in the above formula when $R^4$ is selected from the same groups as $R^3$. The most preferred quaternary ammonium surfactants are the chloride, bromide, and methylsulfate $C_{8-16}$ alkyl trimethyammonium salts, $C_{8-16}$ alkyl di(hydroxyethyl)methylammonium salts, the $C_{8-16}$ alkyl hydroxyethyldimethylammonium salts, $C_{8-16}$ alkyloxypropyl trimethylammonium salts, and the $C_{8-16}$ alkyloxypropyl dihydroxyethylmethylammonium salts. Of the above, the $C_{10-14}$ alkyl trimethylammonium salts are preferred, e.g., decyl trimethylammonium methylsulfate, lauryl trimethylammonium chloride, myristyl trimethylammonium bromide and coconut trimethylammonium chloride, and methylsulfate.

The suds boosters used in the compositions of this invention can contain any one or mixture of the suds boosters listed above.

Calcium or Magnesium Ions

The presence of calcium and/or magnesium (divalent) ions improves the cleaning of greasy soils for various compositions, i.e. compositions containing alkyl ethoxy carboxylates and/or polyhydroxy fatty acid amide. This is especially true when the compositions are used in softened water that contains few divalent ions. It is believed that calcium and/or magnesium ions increase the packing of the surfactants at the oil/water interface, thereby reducing interfacial tension and improving grease cleaning.

Compositions of the invention hereof containing magnesium and/or calcium ions exhibit good grease removal, manifest mildness to the skin, and provide good storage stability. The ions are present in the compositions hereof at an active level of from about 0.1% to 4%, preferably from about 0.3% to 3.5%, more preferably from about 0.5% to 1%, by weight.

Preferably, the magnesium or calcium ions are added as a hydroxide, chloride, acetate, formate, oxide or nitrate salt to the compositions of the present invention.

The amount of calcium or magnesium ions present in compositions of the invention will be dependent upon the amount of total surfactant present therein, including the amount of alkyl ethoxy carboxylates and polyhydroxy fatty acid amide. When calcium ions are present in the compositions of this invention, the molar ratio of calcium ions to total anionic surfactant is from about 0.25:1 to about 2:1 for compositions of the invention.

Formulating such divalent ion-containing compositions in alkaline pH matrices may be difficult due to the incompatibility of the divalent ions, particularly magnesium, with hydroxide ions. When both divalent ions and alkaline pH are combined with the surfactant mixture of this invention, grease cleaning is achieved that is superior to that obtained by either alkaline pH or divalent ions alone. Yet, during storage, the stability of these compositions becomes poor due to the formation of hydroxide precipitates. Therefore, chelating agents discussed herein below may also be necessary.

Other Optional Components

In addition to the essential ingredients described hereinbefore, the compositions contain other conventional ingredients, especially those associated with dishwashing compositions.

The compositions can also contain from about 0.01% to about 15%, preferably from about 1% to about 10%, by weight nonionic detergent surfactants which do not foam and may even inhibit foaming. Suitable nonionic detergents are disclosed in U.S. Pat. Nos. 4,321,165, Smith et al (Mar. 23, 1982) 4,316,824 Pancheri (Feb. 234, 1982) and U.S. Pat. No. 3,929,678, Laughlin et al., (Dec. 30, 1975). Exemplary, non-limiting classes of useful nonionic surfactants are listed below.

1. The polyethylene, polypropylene, and polybutylene oxide condensates of alkyl phenols. In general, the polyethylene oxide condensates are preferred. These compounds include the condensation products of alkyl phenols having an alkyl group containing from 6 to 12 carbon atoms in either a straight- or branched-chain configuration with the alkylene oxide. Commercially available nonionic surfactants of this type include Igepal™ CO-630, marketed by the GAF Corporation; and Triton™ X-45, X-114, X-100, and X-102, all marketed by the Rohm & Haas Company.

2. The condensation products of aliphatic alcohols with from about 1 to about 25 moles of ethylene oxide. The alkyl chain of the aliphatic alcohol can either be straight or branched, primary or secondary, and generally contains from 8 to 22 carbon atoms. Particularly preferred are the condensation products of alcohols having an alkyl group containing from about 10 to about 20 carbon atoms with from about 2 to about 10 moles of ethylene oxide per mole of alcohol.

3. The condensation products of ethylene oxide with a hydrophobic base formed by the condensation of propylene oxide with propylene glycol. The hydrophobic portion of these compounds preferably has a molecular weight of from about 1500 to about 1800 and exhibits water insolubility.

4. The condensation products of ethylene oxide with the product resulting from the reaction of propylene oxide and ethylenediamine.

5. Alkylpolysaccharides disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g., a polyglycoside, hydrophilic group containing from about 1.3 to about 10, preferably from about 1.3 to about 3, most preferably from about 1.3 to about 2.7 saccharide units. U.S. Pat. Nos. 4,373,203 and 4,732,704, incorporated herein by reference, also describe acceptable surfactants.

Other conventional optional ingredients which are usually used in additive levels of below about 5% include opacifiers, antioxidants, bactericides, dyes, perfumes, optical brighteners, and the like.

Optional enzymes such as lipase and/or amylase may be added to the compositions of the present invention for additional cleaning benefits.

Detergency builders can also be present in amounts from 0% to about 50%, preferably from about 2% to about 30%, most preferably from about 5% to about 15%. It is typical in light duty liquid or gel dishwashing detergent compositions to have no detergent builder present. However, certain compositions containing magnesium or calcium ions may require the additional presence of low levels of, preferably from 0 to about 10%, more preferably from about 0.5% to about 3%, chelating agents selected from the group consisting of bicine/bis(2-ethanol)blycine), citrate N-(2-hydroxylethyl) iminodiacetic acid (HIDA), N-(2,3-dihydroxypropyl) iminodiacetic acid (GIDA), and their alkali metal salts. Some of these chelating agents are also identified in the art as detergency builders.

The compositions of this invention may contain for chelating and detergency purposes from about 0.001% to about 15% of certain alkylpolyethoxypolycarboxlyate surfactants of the general formula $$R-O-(\underset{R_1}{CH}-\underset{R_2}{CH}-O)_x-R_3$$

wherein R is a $C_6$ to $C_{18}$ alkyl group, x ranges from about 1 to about 24, $R_1$ and $R_2$ are selected from the group consisting of hydrogen, methyl acid radical succinic acid radical hydroxy succinic acid radical, and mixtures thereof, wherein at least one $R_1$ or $R_2$ is a succinic acid and/or hydroxysuccinic acid radical. An example of a commercially available alkylpolyethoxypolycarboxylate which can be employed in the present invention is POLY-TERGENT C, Olin Corporation, Cheshire, Conn.

The alkylpolyethoxypolycarboxylate surfactant is selected on the basis of its degree of hydrophilicity. A balance of carboxylation and ethoxylation is required in the alkylpolyethoxypolycarboxylate in order to achieve maximum chelating benefits without affecting the cleaning benefits which is associated with the divalent ions or the sudsing of the liquid or gel dishwashing detergent compositions. The number of carboxylate groups dictates the chelating ability, too much carboxylation will result in too strong a chelator and prevent cleaning by the divalent ions. A high degree of ethoxylation is desired for mildness and solubility; however, too high a level will affect sudsing. Therefore, an alkylpolyethoxypolycarboxylate with a modest degree of ethoxylation and minimal carboxylation is desirable.

Other desirable ingredients include diluents and solvents. Diluents can be inorganic salts, such as sodium sulfate, sodium chloride, sodium bicarbonate, etc., and the solvents include water, lower molecular weight alcohols such as ethyl alcohol, isopropyl alcohol, etc. In liquid detergent compositions there will typically be from 0% to about 90%, preferably from about 20% to about 70%, most preferably from about 40% to about 60% of water, and from 0% to about 50%, most preferably from about 3% to about 10% of ingredients to promote solubility, including ethyl or isopropyl alcohol, conventional hydrotropes, etc.

Method Aspect

In the method aspect of this invention, soiled dishes are contacted with an effective amount, typically from about 0.5 ml. to about 20 ml. (per 25 dishes being treated), preferably from about 3 ml. to about 10 ml., of the detergent composition of the present invention. The actual amount of liquid detergent composition used will be based on the judgement of user, and will typically depend upon factors such as the particular product formulation of the composition, including the concentration of active ingredient in the composition, the number of soiled dishes to be cleaned, the degree of soiling on the dishes, and the like. The particular product formulation, in turn, will depend upon a number of factors, such as the intended market ( i.e., U.S., Europe, Japan, etc.) for the composition product. The following are examples of typical methods in which the detergent compositions of the present invention may be used to clean dishes. These examples are for illustrative purposes and are not intended to be limiting.

In a typical U.S. application, from about 3 ml. to about 15 ml., preferably from about 5 ml. to about 10 ml. of a liquid detergent composition is combined with from about 1,000 ml. to about 10,000 ml., more typically from about 3,000 ml. to about 5,000 ml. of water in a sink having a volumetric capacity in the range of from about 5,000 ml. to about 20,000 ml., more typically from about 10,000 ml. to about 15,000 ml. The detergent composition has a surfactant mixture concentration of from about 21% to about 44% by weight, preferably from about 25% to about 40% by weight. The soiled dishes are immersed in the sink containing the detergent composition and water, where they are cleaned by contacting the soiled surface of the dish with a cloth, sponge, or similar article. The cloth, sponge, or similar article may be immersed in the detergent composition and water mixture prior to being contacted with the dish surface, and is typically contacted with the dish surface for a period of time ranging from about 1 to about 10 seconds, although the actual time will vary with each application and user. The contacting of the cloth, sponge, or similar article to the dish surface is preferably accompanied by a concurrent scrubbing of the dish surface.

In a typical European market application, from about 3 ml. to about 15 ml., preferably from about 3 ml. to about 10 ml. of a liquid detergent composition is combined with from about 1,000 ml. to about 10,000 ml., more typically from about 3,000 ml. to about 5,000 ml. of water in a sink having a volumetric capacity in the range of from about 5,000 ml. to about 20,000 ml., more typically from about 10,000 ml. to about 15,000 ml. The detergent composition has a surfactant mixture concentration of from about 20% to about 50% by weight, preferably from about 30% to about 40%, by weight. The soiled dishes are immersed in the sink containing the detergent composition and water, where they are cleaned by contacting the soiled surface of the dish with a cloth, sponge, or similar article. The cloth, sponge, or similar article may be immersed in the detergent composition and water mixture prior to being contacted with the dish surface, and is typically contacted with the dish surface for a period of time ranging from about 1 to about 10 seconds, although the actual time will vary with each application and user. The contacting of the cloth, sponge, or similar article to the dish surface is preferably accompanied by a concurrent scrubbing of the dish surface.

In a typical Latin American and Japanese market application, from about 1 ml. to about 50 ml., preferably from about 2 ml. to about 10 ml. of a detergent composition is combined with from about 50 ml. to about 2,000 ml., more typically from about 100 ml. to about 1,000 ml. of water in a bowl having a volumetric capacity in the range of from about 500 ml. to about 5,000 ml., more typically from about 500 ml. to about 2,000 ml. The detergent composition has a surfactant mixture concentration of from about 5% to about 40% by weight, preferably from about 10% to about 30% by weight. The soiled dishes are cleaned by contacting the soiled surface of the dish with a cloth, sponge, or similar article. The cloth, sponge, or similar article may be immersed in the detergent composition and water mixture prior to being contacted with the dish surface, and is typically contacted with the dish surface for a period of time ranging from about 1 to about 10 seconds, although the actual time will vary with each application and user. The contacting of the cloth, sponge, or similar article to the dish surface is preferably accompanied by a concurrent scrubbing of the dish surface.

Another method of use will comprise immersing the soiled dishes into a water bath without any liquid dishwashing detergent. A device for absorbing liquid dishwashing detergent, such as a sponge, is placed directly into a separate quantity of undiluted liquid dishwashing composition for a period of time typically ranging from about 1 to about 5 seconds. The absorbing device, and consequently the undiluted liquid dishwashing composition, is then contacted individually to the surface of each of the soiled dishes to remove said soiling. The absorbing device is typically contacted with each dish surface for a period of time range from about 1 to about 10 seconds, although the actual time of application will be dependent upon factors such as the degree of soiling of the dish. The contacting of the absorbing device to the dish surface is preferably accompanied by concurrent scrubbing.

As used herein, all percentages, parts, and ratios are by weight unless otherwise stated.

The following Examples illustrate the invention and facilitate its understanding.

EXAMPLE I

A commercial enzyme (a protease), Maxatase®, was added at the level of 26 Anson Units per kilogram of product (Composition A) to a mild, light duty dishwashing liquid (Composition B) comprising 13 parts ammonium $C_{12-13}$ alkylpolyethoxylate(1) sulfate, 14 parts ammonium $C_{12-13}$ alkylpolyethoxylate(12) sulfate, and 5 parts $C_{12}$ alkyldimethyl amine oxide.

A home usage test was conducted with 120 panelists. Half of them used the enzyme containing product (Composition A) and the other half used the non-enzyme product (Composition B) for two weeks. They were then asked to compare the test product with their own product. Composition A was rated significantly higher (>95% confidence level) for product mildness, softness of hands, and smoothness of hands.

Similarly, in a hand immersion test, panelists were asked to soak their hands in the two different product solutions for 30 minutes each day, Monday through Thursday. Their hand conditions were then evaluated by expert graders to evaluate the overall health and the extent of flakiness and panelist preferences between treatments were determined. All results indicated that Composition A treated skin was meister and smoother than Composition B and was more preferred by the panelists.

EXAMPLE II

Light duty liquid dishwashing detergent formulae are as follows:

| | Composition % Weight | | |
|---|---|---|---|
| Ingredient | C | D | E |
| Ammonium $C_{12-13}$ alkyl ethoxy (l) sulfate | 28.50 | 28.50 | 28.50 |
| Coconut amine oxide | 2.61 | 2.61 | 2.61 |
| Betaine/Tetronic 704 ® | 0.87/0.10 | 0.87/0.10 | 0.87/0.10 |
| Ammonium xylene sulfonate | 2.00 | 2.00 | 2.00 |
| Ethanol | 4.00 | 4.00 | 4.00 |
| Ammonium citrate | 0.06 | 0.06 | 0.06 |
| Magnesium chloride | 3.32 | 3.32 | 3.32 |
| Ammonium sulfate | 0.08 | 0.08 | 0.08 |
| Hydrogen peroxide | 200 ppm | 200 ppm | 200 ppm |
| Perfume | 0.18 | 0.18 | 0.18 |
| JR 400 Polymer | 0.00 | 1.00 | 0.00 |
| Protease B | 0.00 | 0.00 | 0.50 |
| Water and minors | | Balance | |

A hand immersion in which panelists were asked to soak each hand in two different solutions, one a day for four days resulted in significantly improved mildness for the protease containing composition (Composition E) as compared to control (Composition C) and composition containing cationic polymer (Composition D).

EXAMPLE III

Light duty liquid dishwashing detergent formulae are as follows:

| Ingredient | Composition % Weight F | G | H |
|---|---|---|---|
| Ammonium $C_{12}$ $C_{13}$ alkyl ethoxy (1) sulfate | 15.500 | 15.500 | 15.500 |
| Ammonium alkyl ethoxy (Ave 6.5) sulfate | 11.900 | 11.900 | 11.900 |
| Amine oxide | 5.000 | 5.000 | 5.000 |
| Ammonium xylene sulfonate | 4.000 | 5.000 | 4.000 |
| Ethanol | 5.500 | 5.500 | 5.500 |
| Sodium chloride | 1.000 | 1.000 | 1.000 |
| Ammonium citrate | 0.100 | 0.100 | 0.100 |
| Perfume | 0.090 | 0.090 | 0.090 |
| Hydrogen peroxide | 0.165 | 0.165 | 0.165 |
| Protease B | 0.000 | 0.050 | 0.150 |
| Water and minors | | Balance | |

A hand immersion test in which panelists were asked to soak their hands twice a day for 15 minutes each for four days resulted in significantly improved skin condition for lower protease containing compositions (G) as compared to control (F) and containing 0.15% active protease (Composition H).

EXAMPLE IV

Light duty liquid dishwashing detergent formulae are as follows:

| Ingredient | Composition % Weight I | J | K |
|---|---|---|---|
| Sodium $C_{12-13}$ alkyl ethoxy (1) sulfate | 6.000 | 6.000 | 6.000 |
| Sodium $C_{12-13}$ alkyl ethoxy (1–3) sulfate | 13.200 | 13.200 | 13.200 |
| $C_{12}$ Glucose Amide | 6.000 | 6.000 | 6.000 |
| Coconut amine oxide | 2.000 | 2.000 | 2.000 |
| Hydrogen peroxide | 0.006 | 0.006 | 0.006 |
| Ethanol | 5.500 | 5.500 | 5.500 |
| Neodol ® $C_{11}E_9$[1] | 5.000 | 5.000 | 5.000 |
| Sodium diethylene penta acetate (40%) | 0.030 | 0.030 | 0.030 |
| Perfume | 0.090 | 0.090 | 0.090 |
| Magnesium++ (added as chloride) | 0.700 | 0.700 | 0.700 |
| Calcium++ (added as chloride) Sodium sulfate | 0.400 | 0.400 | 0.400 |
| | 0.060 | 0.060 | 0.060 |
| Protease B | 0.000 | 0.050 | 0.010 |
| Water and minors | | Balance | |
| pH @10% (As made) | 7.100 | 7.100 | 7.100 |

[1]Nonionic surfactant from Shell

A hand immersion test consisting of eighteen panelists soaking their hands hands in test products once a day for 30 minutes for a total of four days resulted in significant improvements in overall skin condition for both levels of protease containing compositions (J and K) as compared to control (I).

EXAMPLE V

Concentrated light duty liquid dishwashing detergent compositions are as follows:

| Ingredients | % By Weight L | M | N | O I. |
|---|---|---|---|---|
| Diethylenetriamine penta acetate | 0.06 | 0.06 | 0.06 | 0.06 |
| Ethanol | 9.15 | 9.15 | 9.15 | 9.15 |
| Magnesium hydroxide | 2.18 | 2.18 | 2.18 | 2.18 |
| Sucrose | 1.50 | 1.50 | 1.50 | 1.50 |
| Alkyl ethoxy (1.0) sulfate | 34.14 | 34.14 | 34.14 | 34.24 |
| Sodium hydroxide | 1.13 | 1.13 | 1.13 | 1.13 |
| Polyhydroxy fatty acid amide | 6.50 | 6.50 | 6.50 | 6.50 |
| Amine oxide | 3.00 | 3.00 | 3.00 | 3.00 |
| Cocoamidopropyl betaine | 2.00 | 2.00 | 2.00 | 2.00 |
| Perfume | 0.23 | 0.23 | 0.23 | 0.23 |
| Calcium xylene sulfonate | 2.05 | 2.05 | 0.00 | 0.00 |
| Alkyl diphenyl oxide disulfonate[1] | 0.00 | 0.00 | 2.30 | 2.30 |
| Calcium formate | 0.53 | 0.53 | 1.14 | 1.14 |
| Protease B | 0.05 | 0.08 | 0.05 | 0.08 |
| Water | | Balance | | |

[1]DOWFAX 2A

Other compositions of the present invention are obtained when Protease B is substituted with other proteases such as Maxacal®, Savinase®, and BPN.

What is claimed is:

1. A method for soaking hands in the context of a manual dishwashing operation, with reduced skin irritation resulting therefrom, which method comprises:

1) preparing an aqueous dishwashing solution from an effective amount for manual dishwashing of a liquid or gel dishwashing detergent composition comprising:
   (a) from about 5% to 99% by weight of detergent surfactant selected from the group consisting of polyhydroxy fatty acid amides; nonionic fatty alkylpolyglycosides; $C_{8-22}$ alkyl sulfates; $C_{8-22}$ alkyl either sulfates; $C_{8-22}$ olefin sulfonates; $C_{8-22}$ paraffin sulfates; $C_{8-22}$ alkyl glyceryl ether sulfonates; fatty acid ester sulfonates; secondary alcohol sulfates; $C_{11-16}$ secondary soaps; and mixtures of said surfactants;
   (b) from about 0.001% to 5% by weight of active protease in an amount sufficient to provide reduced skin irritation during manual dishwashing operations; and
   (c) from 0% to about 15% by weight of a detergency builder;
   (d) from about 1% to about 20% of a suds booster selected from the group consisting of ethylene oxide condensates, fatty acid amides, amino oxide, semipolar nonionics, betaines, sultaines, cationic surfactants, and mixtures thereof; said composition having a pH from about 4 to about 11; and thereafter
2) immersing the hands of the dishwasher in said dishwashing solution for a period of time which is effective to complete hand washing operations.

2. A handsoaking method according to claim 1 wherein the dishwasher's hands are immersed in said dishwashing solution for a period of at least about 15 minutes.

3. A handsoaking method according to claim 2 wherein said aqueous dishwashing solution is formed by combining from about 3 to 15 ml of said liquid dishwashing detergent composition with from about 1,000 to 10,000 ml of water.

4. A handsoaking method according to claim 3 wherein the liquid dishwashing detergent composition used to form said aqueous washing solution:

a) comprises from about 20% to 60% by weight of said detergent surfactant;

b) comprises from about 0.003% to 4% active protease which is selected from the group consisting of serine proteolytic enzymes obtained from *Bacillus subtilis* or *bacillus licheniformis* or mixtures thereof;

c) comprises from about 2% to 15% by weight of a suds booster selected from betaines, amine oxide semi-polar nonionics, condensation products of aliphatic alcohols with from about 1 to 25 moles of ethylene oxide; and mixtures of said suds boosters; and d) has a pH of from about 6 to 10.

5. A handsoaking method according to claim 4 wherein the liquid dishwashing detergent composition used to form said aqueous washing solution additionally comprises from about 0.01% to 4% by weight of magnesium or calcium ions or mixtures thereof.

6. A handsoaking method according to claim 5 wherein the liquid dishwashing detergent composition used to form said aqueous washing solution additionally comprises from about 0.001% to 10% by weight of an enzyme stabilizing system.

7. A handsoaking method according to claim 5 wherein the liquid dishwashing detergent composition used to form said aqueous washing solution contains from 0% to about 5% by weight of a detergency builder.

8. A handsoaking method according to claim 5 wherein the liquid dishwashing detergent composition used to form said aqueous washing solution contains no detergency builder.

9. A handsoaking method according to claim 5 wherein the dishwasher's hands are immersed in said dishwashing solution for a period of at least about 30 minutes.

* * * * *